US006568222B1

(12) United States Patent
Morita

(10) Patent No.: US 6,568,222 B1
(45) Date of Patent: May 27, 2003

(54) SINKER DEVICE OF FLAT KNITTING MACHINE

(75) Inventor: Toshiaki Morita, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/110,764

(22) PCT Filed: Nov. 15, 2000

(86) PCT No.: PCT/JP00/08063

§ 371 (c)(1),
(2), (4) Date: Apr. 24, 2002

(87) PCT Pub. No.: WO01/36730

PCT Pub. Date: May 25, 2001

(30) Foreign Application Priority Data

Nov. 17, 1999 (JP) ..... 11-326240

(51) Int. Cl.[7] ..... D04B 15/06
(52) U.S. Cl. ..... 66/106; 66/64; 66/109
(58) Field of Search ..... 66/64, 91, 104, 66/106, 105, 107, 108 R, 109

(56) References Cited

U.S. PATENT DOCUMENTS 4,608,841 A 9/1986 Memminger
4,713,948 A * 12/1987 Schmidt et al. ..... 66/106
5,355,699 A * 10/1994 Inagaki et al. ..... 66/64
5,570,592 A * 11/1996 Takegawa ..... 66/64
5,918,483 A 7/1999 Stoll
6,079,233 A * 6/2000 Shima ..... 66/106

FOREIGN PATENT DOCUMENTS

| | | |
|---|---|---|
| JP | 9-31806 | 2/1997 |
| JP | 11-1850 | 1/1999 |
| JP | 11-61604 | 3/1999 |

* cited by examiner

*Primary Examiner*—Danny Worrell
(74) *Attorney, Agent, or Firm*—Rothwell, Figg, Ernst & Manbeck, P.C.

(57) ABSTRACT

A sinker device comprises a sinker jack 50 which can be freely advanced and retracted with respect to a needle bed gap 4 and a sinker 30 supported on an upper surface of the sinker jack formed as a supporting surface in a freely swingable manner. The sinker 30 and the sinker jack 50 have sliding contact surfaces sidably contactable with each other which are each formed at a front side thereof with respect to a swinging pivot point. When the sinker jack 50 is advanced toward the needle bed gap 4 to move relative to the sinker 30, the sinker 30 takes the swinging attitude controlled by the sliding contact relation between the respective sliding contact surfaces of the sinker and the sinker jack, so that the sinker 30 is controllably swung to at least a knitted loop pushing level, a knitted loop releasing level and a stitch forming level.

6 Claims, 6 Drawing Sheets

SINKER DEVICE OF FLAT KNITTING MACHINE

TECHNICAL FIELD

The present invention relates to a sinker device of a flat knitting machine for biasing a knitted loop in a direction of its being pushed down to a needle bed gap between needle beds arranged opposite in back and front.

BACKGROUND ART

The applicant previously proposed a sinker device disclosed by Japanese Laid-open (Unexamined) Patent Publication No. Hei 9 (1997)-31806. In this sinker device, a pivoting portion of a sinker is pivotally supported in a semicircular pivot slot formed in the needle plate, and the sinker is freely turned forwardly and backwardly about a pivot shaft of the pivoting portion of the sinker in the state in which a stitch holding hook of the sinker is always urged in a direction for a knitted loop to be pushed down by elastically urging means. The sinker is provided with a control butt so that the engagement of the control butt with a cam mounted on the carriage can permit the sinker to be retracted from the needle bed gap against a biasing force of the biasing means for the required retracting motion of the sinker in the process of stitch forming. Further, the sinker is provided, at a lower portion thereof, with a sinker rest plate to be freely advanced and retracted with respect to the needle bed gap so that when the sinker rest plate is advanced, with the carriage cam engaged with the control butt of the sinker rest plate, the front end portion of the plate can press down the sinker to hold it in its rest position where the stitch holding hook does not act to urge the knitted loop downwards when the carriage is passed.

The sinker device thus constructed enables the knitted loop to be held by the stitch holding hook under adequate tension from the elastic biasing means and also enables the stitch holding hook to be held in its rest position where no tension is placed on the knitted loop when the carriage is passed, thus providing an enlarged gap for the needle bed gap between the front and back needle beds. This holding of the stitch holding hook in its rest position can provide the advantage that even when the needle bed is racked in knitting a fabric with a thicker yarn, the stitch holding hook of the sinker can be kept from scratching a fabric held by the needles on the opposite needle bed to damage it.

However, in order for the sinker to operate to provide the required actions mentioned above, this sinker device is required to have a control system for controllably advance and retract the sinker and another control system for controllably advance and retract the sinker rest plate.

Also, in this sinker device, since the pivot shaft of the sinker is fixed at a fixed position of the needle plate, when the stitch is formed, the stitch forming edge of the sinker is always held at a fixed position without any advancing and retracting motion with respect to the advancing and retracting direction of the knitting needle.

It is an objective of the present invention to provide a sinker device that can permit a swinging motion of the sinker that is constructed to hold a knitted loop under adequate tension and the rest retention via a single control system.

It is another objective of the present invention to provide a sinker device that can permit the stitch forming edge of the sinker to be advanced and retracted in the advancing and retracting direction of the knitting needle, so as to reduce the stroke of the knitting needle.

DISCLOSURE OF THE INVENTION

In accordance with one aspect of the invention, there is provided a sinker device of a flat knitting machine comprising at least a pair of front and back needle beds which are opposed to each other across a needle bed gap, either or both of which is/are sidable in a lateral direction thereof; a number of knitting needles which are set in needle grooves arranged in series on the needle beds so as to be freely advanced and retracted; sinkers, each having a stitch forming edge and a stitch holding hook and arranged between adjacent knitting needles so as to be freely swingable; and biasing means for biasing a knitted loop downwards to push it into the needle bed gap by the stitch forming hook, the sinker device further comprising sinker jacks which can be freely advanced and retracted with respect to the needle bed gap and on which the respective sinkers are supported in a freely swingable manner, wherein the sinkers and the sinker jacks each have sliding contact surfaces sidably contactable with each other which are each formed at a front side thereof with respect to a swinging pivot point, so that when the sinker jack is advanced toward the needle bed gap to move relative to the sinker, the sinker can take a swinging attitude controlled by the sliding contact relation between the respective sliding contact surfaces of the sinker and the sinker jack so that the sinker can be controllably swung to at least a knitted loop pushing level, a knitted loop releasing level and a stitch forming level.

The sinker forms therein the swinging pivot point, and the sinker jack has a control butt to engage with a carriage cam so as to control an advancing and retracting motion of the sinker jack.

Also, the sinker is so structured that it can be advanced toward the needle bed gap by the sinker jack, while it is kept at its stitch forming level.

According to this construction, the sinker supported on the sinker jack is so biased by the elastic biasing means that its stitch holding hook can be swung downwards and their respective sliding contact surfaces formed on the sinker and the sinker jack are always urged into contact with each other at a location forward of the swinging pivot point. Also, when the sinker jack is advanced and retracted by the carriage cam to move relative to the sinker, the sinker is controllably swung to at least a knitted loop pushing level, a knitted loop releasing level and a stitch forming level by the sliding contact relation between the mutually sidably contactable sliding contact surfaces.

In accordance with another aspect of the invention, there is provided a sinker device of a flat knitting machine comprising at least a pair of front and back needle beds which are opposed to each other across a needle bed gap, either or both of which is/are sidable in a lateral direction thereof, a number of knitting needles which are set in needle grooves arranged in series on the needle beds so as to be freely advanced and retracted; and freely swingable sinkers, each being arranged between adjacent knitting needles and being biased downwards by biasing means, to push a knitted loop into the needle bed gap by a stitch forming hook of the sinker, the sinker device further comprising sinker jacks which can be freely advanced and retracted with respect to the needle bed gap and over which the respective sinkers are disposed, wherein each sinker includes a longitudinally extending shank, a stitch holding hook with a stitch forming edge provided at a front end portion of the shank, a protuberance protruded downwardly from a part of the shank to abut with a supporting surface of the sinker jack, and a sliding contact surface extending forward of the protuberance and formed by a lower surface of the shank to slidably contact with a first projection of the sinker jack being so formed as to vary in level along a longitudinal direction thereof, and wherein each sinker jack includes a longitudinally extending shank, the first projection formed on an upper surface of the shank of the sinker jack confronting the sinker at a front end portion thereof, a supporting surface for supporting the protuberance of the sinker, and a control butt formed at a tail portion thereof to engage with the carriage cam so as to control an advancing and retracting motion of the sinker jack, whereby the advancing and retracting motion of the sinker jack controlled by the carriage cam can make the first projection of the sinker jack move along the sliding contact surface formed on the sinker so that the sinker can take a predetermined swinging attitude in accordance with the varied level of the sliding contact surface.

According to this construction, the sinker is always biased downwards by the elastic biasing means and the protuberance provided in the shank of the sinker is supported on the sinker jack arranged to be freely advanced and retracted with respect to the needle bed gap in abutment therewith so that a knitted loop held on the knitting needle can be urged into the space under the needle bed gap, with adequate tension placed on the knitted loop by the stitch holding hook. As a result of this, the sliding contact surface formed forward of the protuberance of the sinker and the first projection formed in the sinker jack are always press-contacted with each other. When the butt of the sinker jack is advanced and retracted by the cam mounted on the carriage, the sliding contact surface of the sinker and the first projection of the sinker jack are moved relative to each other while they are sidably contacted with each other. Since the sliding contact surface of the sinker is formed to vary in level along the longitudinal direction of the shank, the sinker can take a required swinging attitude for knitting a fabric (knitted loop pushing level, knitted loop releasing level and knitted loop forming level) in accordance with the varied level.

The biasing means is formed by an elastic leg formed to be branched from the shank of the sinker.

According to this construction, the stitch forming hook can be elastically biased downwards by the sinker itself without any extra elastically biasing means such as a spring, thus reducing a component count of the sinker device and also facilitating maintenance such as a parts replacement.

Also, the sinker jack is provided with a second projection to engage with a rear surface of the protuberance of the sinker so as to advance the sinker so that when the sinker jack is advanced farther than a given stroke, the second projection can urge the sinker toward the needle bed gap.

According to this construction, when the knitting needle is retracted along the stitch cam for forming a stitch, the protuberance of the sinker is pushed out by the projection of the sinker jack to advance the stitch forming edge toward the needle bed gap, thus reducing the stroke of the knitting needle to an extent corresponding to such an advance of the stitch forming edge.

As mentioned above, according to the sinker device of the present invention, since controllably advancing and retracting the control butt provided in the sinker jack can permit the sinker to be held not only in a position to place adequate tension on the knitted loop, but also in a rest position to place no tension on the knitted loop, it is only necessary for the sinker device to provide a single control system therefor.

BRIEF DESCRIPTION OF THE DRAWINGS

FIG. 1A shows a sectional view of the same depicted from a knitting needle; and FIG. 1B shows a sectional view of the same depicted from a sinker.

BEST MODE FOR CARRYING OUT THE INVENTION

A certain preferred embodiment of a sinker device of the present invention will be described in detail below with reference to the accompanying drawings.

Figure 1:
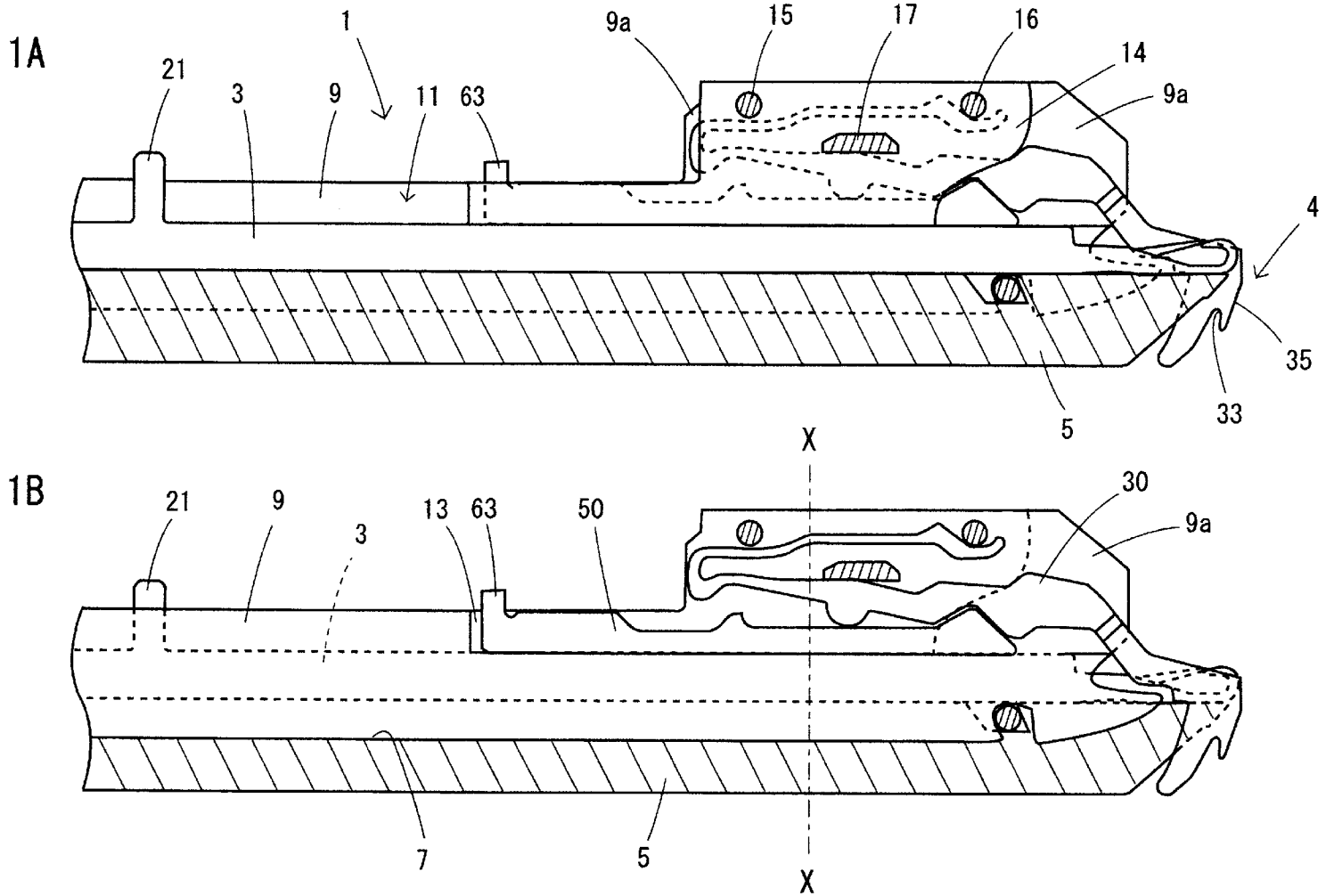
FIG. 1 shows a sectional view of a forefront portion of one needle bed fitted with a sinker device according to an embodiment of the present invention.
Figure 2:
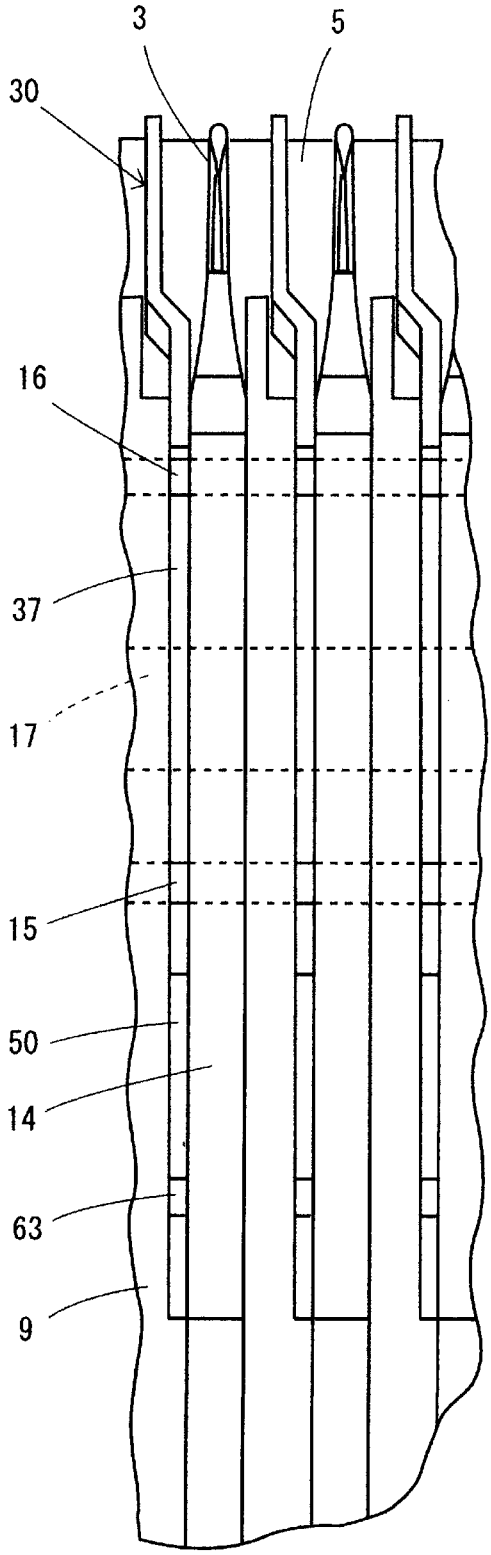
FIG. 2 is a plan view of a forefront portion of the needle bed.
Figure 3:
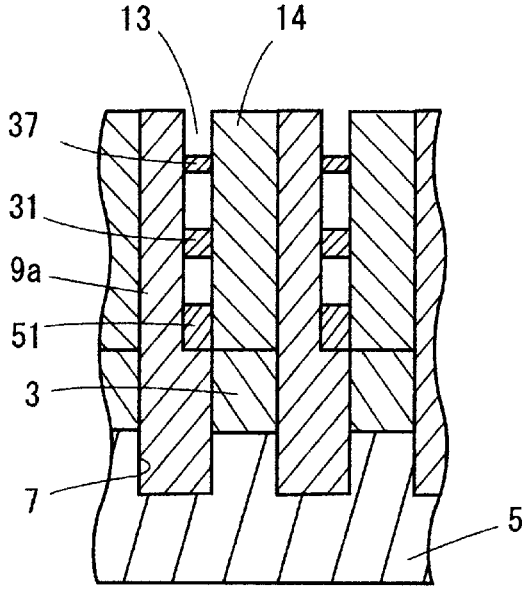
FIG. 3 is a sectional view of the same taken along line X—X of 1B of FIG. 1.
Figure 4:
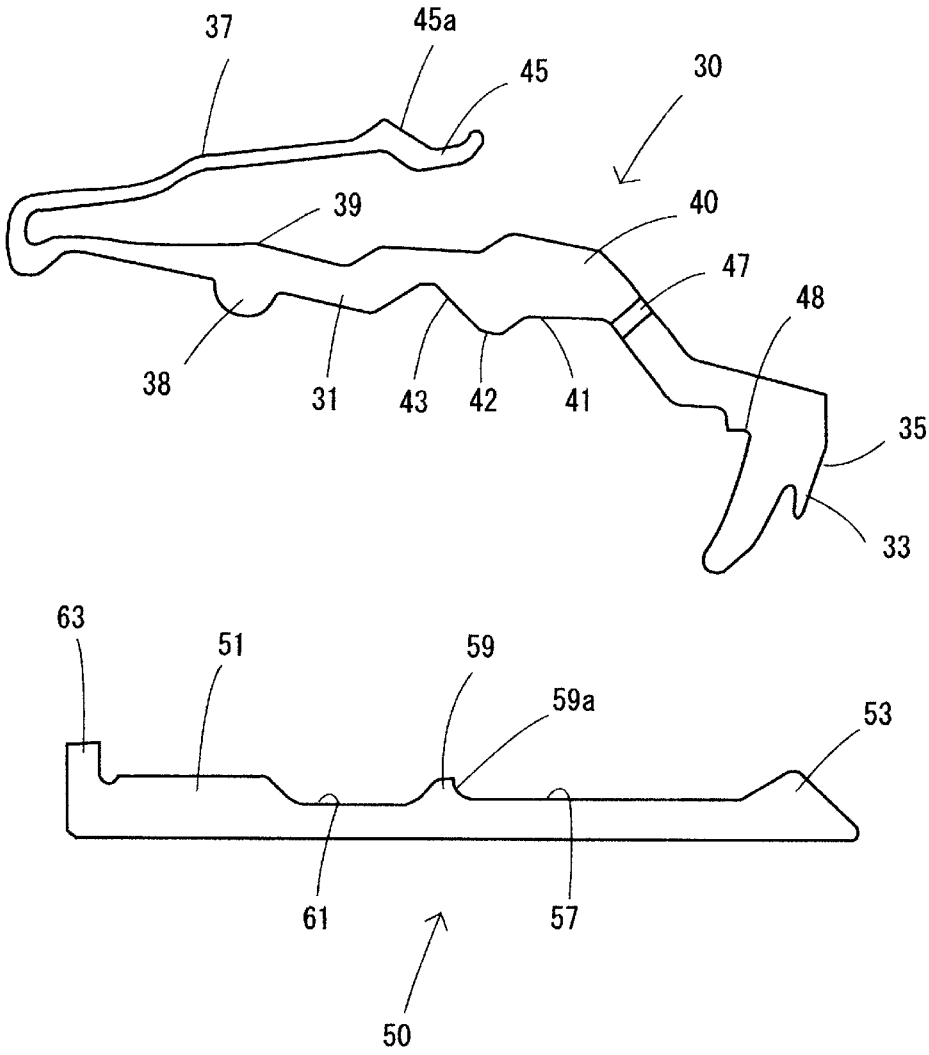
FIG. 4 shows parts fitted in the needle bed.

A flat knitting machine used with a sinker device of the illustrated embodiment comprises a pair of front and back needle beds 1 having a large number of knitting needles 3 which are opposed to each other across a needle bed gap 4 and either or both of which is/are slaidably moved in a longitudinal direction thereof. Shown in FIG. 1 is only one needle bed fitting a latch needle therein. The needle bed 1 is provided with a number of needle plates 9 set in a number of slits 7 grooved in the basal plate 5. With the space defined between adjacent needle plates 9, 9 as a needle groove 11, each knitting needle 3 is accommodated in the needle groove 11. The needle plate 9 has, at a forefront portion 9*a* thereof on the needle bed gap side, a raised portion higher than the remaining portion. The raised portion is cut off at one side thereof to form an accommodating portion 13 for accommodating a sinker jack 50 and a sinker 30 placed over it. A spacer 14 is fitted in the needle groove in such a relation as to be positioned at the lateral side of the sinker 30 and sinker jack 50 and over the knitting needle 3. Wires 15, 16 passing through the spacer 14 and the needle plates 9 are extended along the widthwise direction of the needle bed. 17 denotes a presser plate which is extended along the widthwise direction of the needle bed 1 to prevent the sinker 30, the sinker jack 50 and the spacer 14 from slipping off from the accommodating portion 13. The presser plate 17 works to constantly press a protuberance 38 of the sinker 30 serving as a swinging pivot point against a supporting surface 57 of the sinker jack 50.

The sinker 30 has a shank 31 extending in the longitudinal direction. The shank 31 has a stitch holding hook 33 formed at a head portion thereof, a stitch forming edge 35 formed at an upper side of the stitch holding hook 33, and an integrally formed elastic leg 37 serving as elastically biasing means which is folded upwardly at a tail portion thereof and extends forwardly therefrom. Also, the shank 31 has the protuberance 38 serving as the swinging pivot point of the sinker which is formed in one side thereof confronting the sinker jack 50 in an area between the presser plate 17 and the sinker jack 50 and an abutting surface 39 which is formed in the other side thereof confronting the presser plate 17 in that area.

In addition, the shank 31 has, in an area between the tip and the protuberance 38, an upwardly curved portion 40.

The curved portion 40 has, in a bottom thereof, a first sliding contact surface 41, a second sliding contact surface 42 and a third sliding contact surface 43 which are continuously formed to vary in height so that they can slidably contact with a first projection 53 of the sinker jack 50 to control a swinging attitude of the sinker, as mentioned later. The sinker 30 is bent at a bent portion thereof 47 so that its front end portion can be located in the center of the space defined between adjacent knitting needles 3, 3 when the sinker 30 is accommodated in the needle bed. The elastic leg 37 is accommodated in a compressed state, with its receiving portion 45 retained by the wire 15, as shown in FIG. 1. The resilient force of the elastic leg 37 biases the stitch holding hook 33 of the sinker 30 to swing downwardly. While in the illustrated embodiment, the elastic leg 37 formed to be integral with the shank 31 is presented as elasticity biasing means, an elastic member, such as a spring, separate from the shank may be bridged over the sinker to be used as the elasticity biasing means, as in the sinker device disclosed by Japanese Laid-open (Unexamined) Patent Publication No. Hei 9 (1997)-31806 as cited above. 45*a* denotes an inclined surface formed in the receiving portion. 48 denotes a stopper adapted to abut with the front end portion of the needle bed to control a lower limit position of the stitch holding hook when fully swung.

The sinker jack 50 has a longitudinally extending shank 51 which has, on an upper surface thereof, a first projection 53, a flat supporting surface 57 for supporting the protuberance 38 of the sinker 30, a second projection 59, and a control butt 63 to be controllably advanced and retracted by a carriage cam which are formed in the head-to-tail order. The sinker jack 50 is engaged with a sinker cam, mentioned later, and accommodated in such a relation as to be freely advanced and retracted with respect to the needle bed gap.

Figure 5:
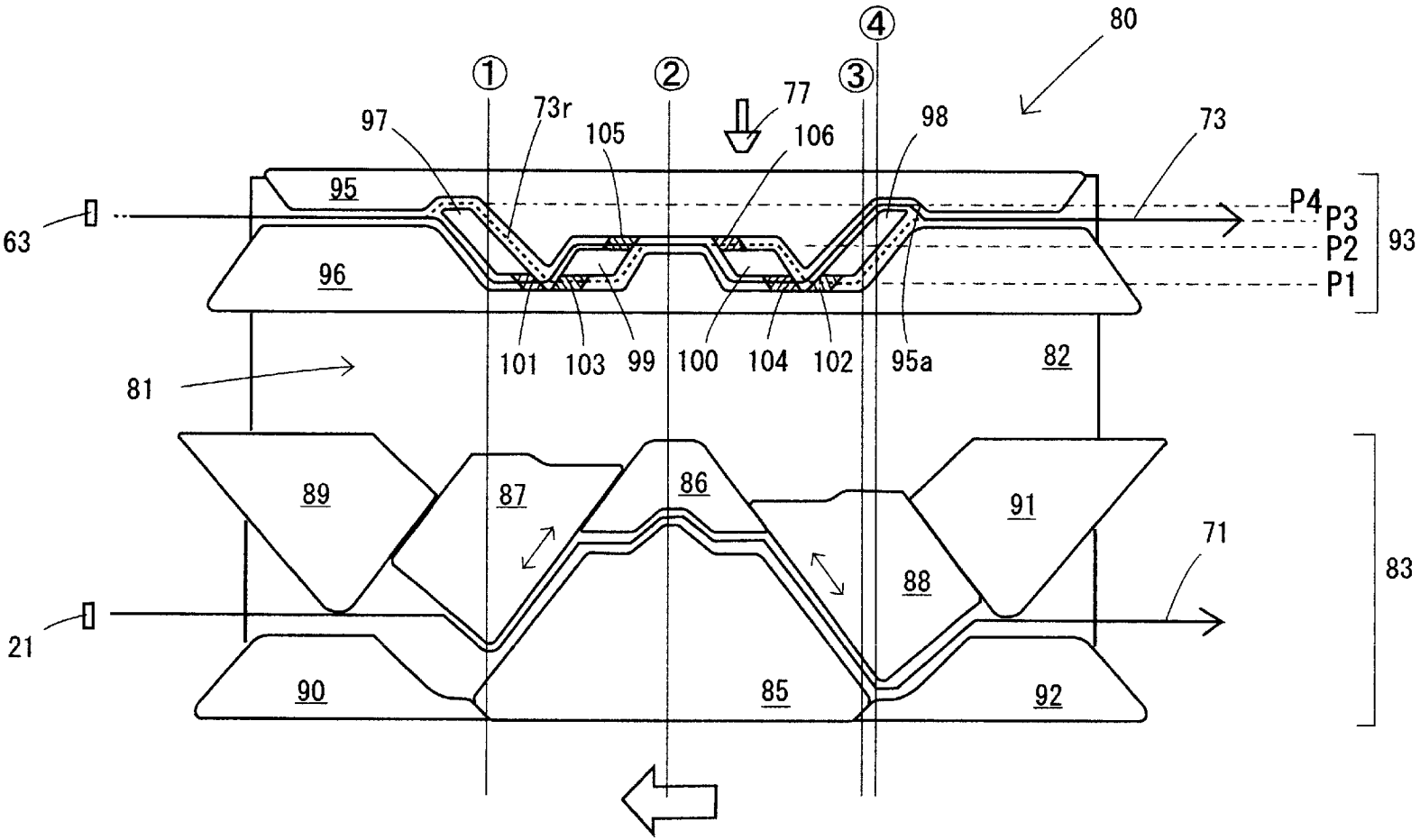
FIG. 5 shows traverse routes of butts to control a back-and-forth motion of the knitting needle and sinker when a carriage is traveled leftwards and a knitting lock of the carriage, and FIGS. 6A–6D of FIG. 6 are side views showing the state of the sinker and the sinker jack in respective phases ①–④ of FIG. 5.

FIG. 5 shows traverse routes 71 and 73 of the butts 21 and 63 to control an advance-and-retract motion of the knitting needle and sinker when the carriage is traveled leftwards and a knitting lock 81 mounted on a cam plate 82 of the carriage 80. Indicated by a broken line 73r is a traverse route of the butt 63 of the sinker when the carriage is traveled rightwards. The knitting rock 81 comprises a knitting needle control cam 83 to controllably advance and retract a butt 21 of the knitting needle and a sinker jack control cam 93 to controllably advance and retract the sinker jack 50 disposed on the needle bed gap side. The knitting needle control cam 83 has a fixed raising cam 85, a bridge cam 86, guide cams 89–92, and a pair of switch cams 87 and 88 sidable in the directions indicated by arrows. The sinker jack control cam 93 comprises large fixed guide cams 95 and 96, small fixed guide cams 97–100 arranged therebetween, and retractable-type movable guide cams 101–106 (shaded area) only operable in either traveling direction of the carriage. When the carriage 80 is traveled leftwards, the cams 105, 104 and 102 of the movable guide cams 101–106 are brought into engagement with the butt 63 of the sinker jack 50 to advance or retract the butt 63. On the other hand, when the carriage 80 is traveled rightwards, the movable cams 106, 103 and 101 are brought into engagement with the butt 63 of the sinker jack 50 to advance or retract the but 63.

Now, operation of the sinker device thus constructed will be described below.

Figure 6:
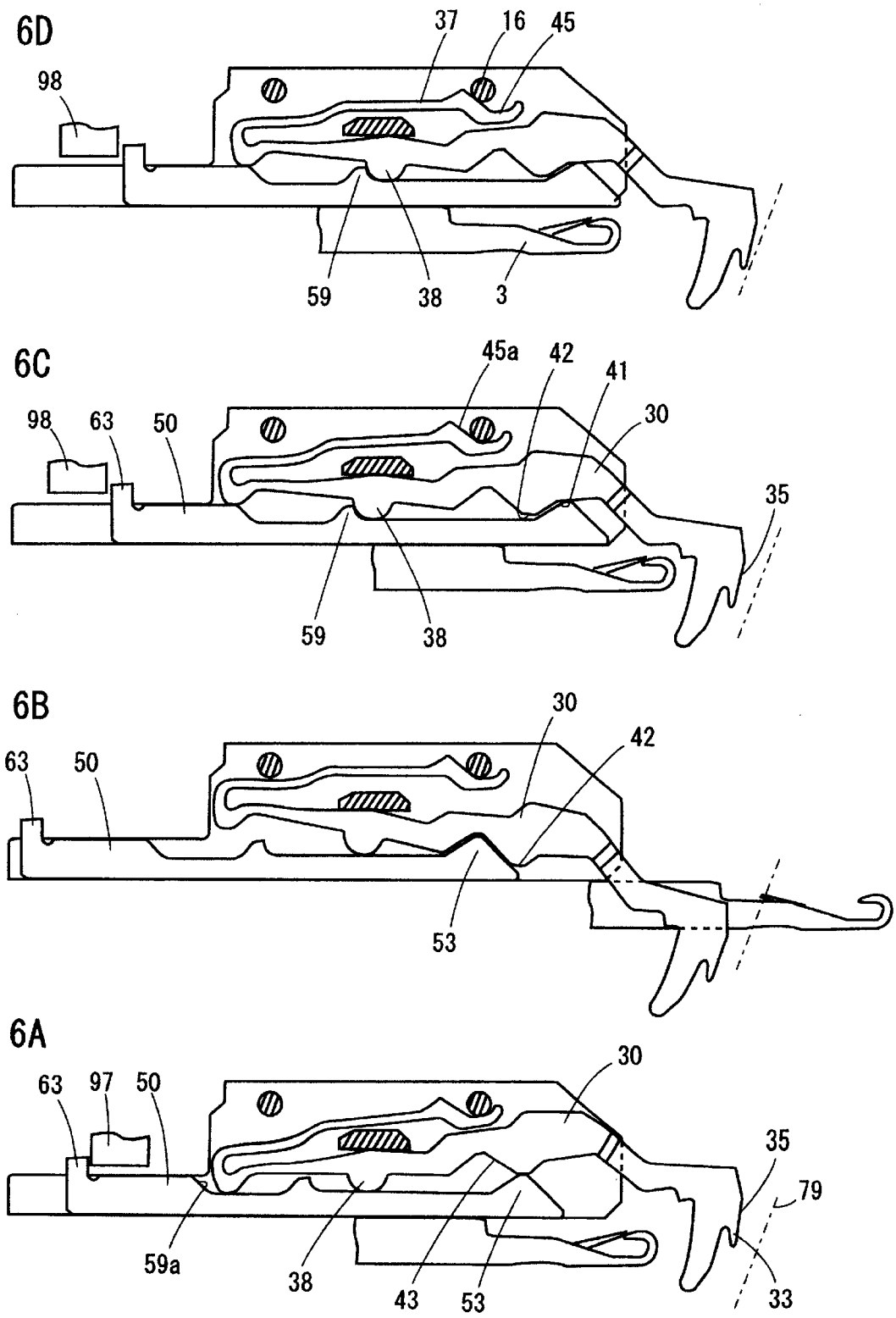

P1–P4 shown in FIG. 5 indicate the advanced positions of the butt 63 of the sinker jack 50, respectively. 6A–6D of FIG. 6 are side elevation views, schematically showing the state of the sinker and the slider jack in the respective phases ①–④ of FIG. 5.

(Phase ①)

Before a new stitch is formed in the knitting lock 81, the stitch holding hook 33 of the sinker is raised, first, in the interval of which the knitting needle 3 is pulled down to string up the stitch, and then the stitch holding hook 33 is lowered to hook a knitted loop, not shown. The phase ① represents the intermediate motion, showing that the stitch holding hook 33 is in a raised position.

As shown in the route 73, the butt 63 of the sinker jack 50 which was located in P3 is retracted to P2 by the sinker jack control cam 97 in the phase ①. This relative displacement between the sinker jack 50 and the sinker 30 causes the first projection 53 of the sinker jack 50 to move along the sliding contact surface of the sinker 30 from the first sliding contact surface 41 to the second sliding contact surface 42. This causes the sinker 30 to swing in the counterclockwise direction centered on the protuberance 38 serving as the fulcrum, to urge the stitch holding hook 33 to the highest position. At this time, the knitting needle 3 is somewhat pulled down by the stitch cam 87 to string up the knitted loop held thereby.

(Phase ②)

The phase ② represents the state that the control butt 63 of the sinker jack 50 is retracted to the position P1 by the guide cams 105 and 99. Since the sinker 30 is elastically biased in a direction for the stitch holding hook 33 to push the stitch into the space under the needle bed gap, the sinker, in this phase, is swung deep downwards until the first projection 53 is fitted in concavity of the first sliding contact surface 43 to hook the knitted loop. During this time, the butt 21 is guided along the raising cam 85 up to the top thereof and the knitting needle 3 is advanced most. During this time, the loop is held on the stitch holding hook 33 under adequate tension from elasticity bias of the elastic leg 37.

In the subsequent position corresponding to a yarn feeder 77, the butt 63 of the sinker jack 50 is advanced to the position P2 by the guide cams 104 and 100, so that the first projection 53 of the sinker jack is shifted from the third sliding contact surface 43 toward the second sliding contact surface 42, through not shown. This causes the sinker 30 to swing in a direction to lift the stitch holding hook 33, so as to release the knitted loop from the stitch holding hook 33.

(Phase ③)

Then, in the first half of the motion of the knitting needle 3 being retracted along the trailing stitch cam 88, the butt 63 of the sinker jack 50 is pushed out forwards and raised up to the position P3 by the guide cams 102 and 98, in order for the stitch forming edge 35 to act on a knitted loop that is just about being formed. The phase ③ represents the state that the butt 63 is pushed up to the position P3. During this time, the sinker jack 50 and the sinker 30 are displaced relative to each other. This relative displacement causes the first projection 53 to move along the sliding contact surface from the second sliding contact surface 42 toward the first sliding contact surface 41. This causes the sinker 30 to swing in the counterclockwise direction to urge the stitch forming edge 35 upwards. The second projection 59 is not brought into abutment with the protuberance 38 of the sinker 30 before the butt 63 of the sinker jack 50 is advanced up to the position P3.

(Phase ④)

In the second half of the subsequent motion of the knitting needle 3 being further retracted by the stitch cam 88, the butt 63 of the sinker jack 50 is further advanced to the position P4 by the guide cam 98. This causes the protuberance 38 of the sinker 30 to be pushed out forward by the second projection 59, resulting in that the sinker 30 is advanced toward the needle bed gap, keeping its swung position to form a stitch shown in 6C of FIG. 6 (6D of FIG. 6). At this time, a knitting yarn fed to the knitting needle 3 is extended from the stitch forming edge 35 to the hook of the knitting needle 3. Thus, since advancing the sinker jack 50 to the position P4 during the retracting motion of the knitting needle 3 forces the sinker 30 to advance and further forces the stitch forming edge 35 to advance toward the center line 79 of the needle bed gap, the same effect as substantial increase of the stroke of the knitting needle 3 is produced. This enables forming a larger loop without increasing the stroke of the knitting needle.

In the phase ④, the sinker 30 is forced to advance with the rear edge of the protuberance 38 engaged with a front edge 59*a* of the second projection 53 of the sinker jack 50, and as such forces the elastic leg 37 to be further compressed by the inclined surface 45*a* formed in the receiving portion 45 of the elastic leg 37 being run into under the wire 16, with the inclined surface 45*a* abutted with the wire 16. As a result of this, the sinker 30, after passing the phase ④, is retracted to the position P3 by its own resiliency when the butt 63 of the sinker jack 50 is retracted along the clearing cam surface 95*a* of the guide cam 95. Thus, after the carriage is passed, the sinker 30 lifts its stitch holding hook 33 and displaces it from a stitch holding position (position 6B of FIG. 6) to a position even in level with the position 6C, thus providing an enlarged gap between the front and back needle beds. Additionally, a selectively switchable cam (not shown) that forces the butt 63 of the sinker jack to be retracted to the position P1 after passage of the carriage may be attached to the sinker jack control cam 93 so that a knitted loop that has just been formed after the passage of the carriage can be elastically held by the stitch holding hook 33.

The sinker device of the illustrated embodiment is so constructed that only the control butt 63 provided at the tail of the shank 51 extending rearwards of the sinker jack 50 can controllably be advanced and retracted via the cam provided in the carriage, to allow the sinker 30 to swing from the operative position to place tension on the knitted loop to the rest position to place no tension on the knitted loop and further to the advanced position of the stitch forming edge 35 of the sinker. This construction can eliminate the need of the control butt for controlling the swinging position of the sinker and also can eliminate the need of providing the sinker control cam on the surface of the carriage confronting the sinker, differently from the prior art. This can restrain part of the needle bed around the needle bed gap from becoming bulky and also can permit an auxiliary bed to be disposed in close proximity to the needle bed in the case of a so-called three-bed flat knitting machine or four-bed flat knitting machine having the auxiliary bed accommodating therein knitting members including a transfer jack and arranged over the needle bed.

Although in the embodiment illustrated above, the needle plates 9 are cut off at one side thereof to form the accommodating portion for accommodating the sinker and the sinker jack, the sinker and the sinker jack may be accommodated immediately over the knitting needle in the space between adjacent needle plates.

While the illustrated embodiment is so constructed that the protuberance provided in the shank of the sinker is supported on the sinker jack and also the sliding contact surfaces arranged on the sinker side are so formed as to vary in level along the longitudinal direction so that they can sidably contact with the first projection of the sinker jack to control the swinging attitude of the sinker in accordance with the varied level of the sliding contact surfaces, modifications may be made in the present invention without limiting to this construction. The sidably contacting portions of the sinker and sinker jack to cooperate with each other may be designed to have such a configuration that when the sinker jack is operated to be advanced and retracted relative to the sinker, the sinker supported on the sinker jack can take a required swinging attitude.

While the cam structure of the sinker jack control cam and the traverse routes of the butt are shown in a limited manner in FIG. 5, the cam structure may properly be modified so that the sinker can take a desirable swinging attitude in accordance with kinds of knitting needles used, such as a latch needle and a compound needle, and knitting conditions including a knitting yarn and a knitting structure.

Also, the swinging attitude of the sinker may be so changed that the front edge portion extending to the tip of the sinker can be worked as the stitch forming edge. In this modification, a knitted loop that has just been formed by a loop being drawn in by the stitch cam can be elastically held by the stitch holding hook without retracting the sinker.

CAPABILITIES OF EXPLOITATION IN INDUSTRY

The present invention can provide a sinker device that enables the swinging motion of the sinker and the retention of the rest position by using a single control system, as mentioned above.

What is claimed is:

1. A sinker device of a flat knitting machine comprising at least a pair of front and back needle beds which are opposed to each other across a needle bed gap, either or both of which is/are sidable in a lateral direction thereof; a number of knitting needles which are set in needle grooves arranged in series on the needle beds so as to be freely advanced and retracted; sinkers, each having a stitch forming edge and a stitch holding hook and arranged between adjacent knitting needles so as to be freely swingable; and biasing means for biasing a knitted loop downwards to push it into the needle bed gap by the stitch forming hook, the sinker device further comprising sinker jacks which can be freely advanced and retracted with respect to the needle bed gap and on which the respective sinkers are supported in a freely swingable manner, wherein the sinkers and the sinker jacks have sliding contact surfaces sidably contactable with each other which are each formed at a front side thereof with respect to a swinging pivot point so that when the sinker jack is advanced toward the needle bed gap to move relative to the sinker, the sinker can take a swinging attitude controlled by the sliding contact relation between the respective sliding contact surfaces of the sinker and the sinker jack so that the sinker can be controllably swung to at least a knitted loop pushing level, a knitted loop releasing level and a stitch forming level.

2. The sinker device of the flat knitting machine according to claim 1, wherein the sinker forms therein the swinging pivot point, and the sinker jack has a control butt to engage with a carriage cam so as to control an advancing and retracting motion of the sinker jack.

3. The sinker device of the flat knitting machine according to claim 1, wherein the sinker is so structured that it can be advanced toward the needle bed gap by the sinker jack, while it is kept at its stitch forming level.

4. A sinker device of a flat knitting machine comprising at least a pair of front and back needle beds which are opposed to each other across a needle bed gap, either or both of which is/are slidable in a lateral direction thereof; a number of knitting needles which are set in needle grooves arranged in series on the needle beds so as to be freely advanced and retracted; and freely swingable sinkers, each being arranged between adjacent knitting needles and being biased downwards by biasing means, to push a knitted loop into the needle bed gap by a stitch forming hook of the sinker, the sinker device further comprising sinker jacks which can be freely advanced and retracted with respect to the needle bed gap and over which the respective sinkers are disposed, wherein each sinker includes a longitudinally extending shank, a stitch holding hook with a stitch forming edge provided at a front end portion of the shank, a protuberance protruded downwardly from a part of the shank to abut with a supporting surface of the sinker jack, and a sliding contact surface extending forward of the protuberance and formed by a lower surface of the shank to sidably contact with a first projection of the sinker jack being so formed as to vary in level along a longitudinal direction thereof, wherein each sinker jack includes a longitudinally extending shank, the first projection formed on an upper surface of the shank of the sinker jack confronting the sinker at a front end portion thereof, a supporting surface for supporting the protuberance of the sinker, and a control butt formed at a tail portion thereof to engage with the carriage cam so as to control an advancing and retracting motion of the sinker jack, whereby the advancing and retracting motion of the sinker jack controlled by the carriage cam can make the first projection of the sinker jack move along the sliding contact surface formed on the sinker so that the sinker can take a predetermined swinging attitude in accordance with the varied level of the sliding contact surface.

5. The sinker device of the flat knitting machine according to claim 4, wherein the biasing means is an elastic leg formed to be branched from the shank of the sinker.

6. The sinker device of the flat knitting machine according to claim 4, wherein the sinker jack is provided with a second projection to engage with a rear surface of the protuberance of the sinker so as to advance the sinker so that when the sinker jack is advanced farther than a given stroke, the second projection can urge the sinker toward the needle bed gap.

* * * * *